US005708421A

United States Patent [19]

Boyd

[11] Patent Number: 5,708,421

[45] Date of Patent: Jan. 13, 1998

[54] SYSTEM FOR TRACKING AN ARTICLE OR PERSON

[75] Inventor: Randy D. Boyd, Knoxville, Tenn.

[73] Assignee: Radio Systems Corp., Knoxville, Tenn.

[21] Appl. No.: 699,399

[22] Filed: Aug. 19, 1996

[51] Int. Cl.[6] ..... G08B 13/181; G08B 21/00

[52] U.S. Cl. ..... 340/573; 119/721; 340/539; 340/572

[58] Field of Search ..... 340/573, 539, 340/572; 119/721

[56] References Cited

U.S. PATENT DOCUMENTS

| | | | |
|---|---|---|---|
| 4,598,272 | 7/1986 | Cox | 340/539 |
| 4,675,656 | 6/1987 | Marcisse | 340/573 |
| 4,785,291 | 11/1988 | Hawthorne | 340/573 |
| 4,967,695 | 11/1990 | Giunta | 119/721 |
| 5,119,072 | 6/1992 | Hemingway | 340/539 |
| 5,196,825 | 3/1993 | Young | 340/539 |
| 5,289,163 | 2/1994 | Perez et al. | 340/539 |
| 5,396,218 | 3/1995 | Olah | 340/539 |
| 5,583,488 | 12/1996 | Sala et al. | 340/539 |
| 5,589,821 | 12/1996 | Sallen et al. | 340/539 |

*Primary Examiner*—Glen Swann
*Attorney, Agent, or Firm*—Pitts and Brittian, P.C.

[57] ABSTRACT

A system for tracking articles or persons comprising a base unit for transmitting a series of ultrasonic signals and an alarm signal, a remote unit, removably attached to the article or person, for receiving the series of ultrasonic signals from the base unit and for transmitting an electromagnetic signal upon receipt of the ultrasonic signal from the base unit, and a monitoring unit for receiving the alarm signal. The base unit further includes an ultrasonic signal generator, an ultrasonic signal transmitter, an electromagnetic signal receiver for receiving the signal from the remote unit, a timer for determining the amount of time from the transmission of the ultrasonic signals to the receipt of the electromagnetic signal from the remote unit, and a transmitter for transmitting an alarm signal to the remote unit and the monitoring unit when the amount of time from the transmission of the ultrasonic signals to the receipt of the electromagnetic signal from the remote unit is greater than a predetermined amount of time.

15 Claims, 6 Drawing Sheets

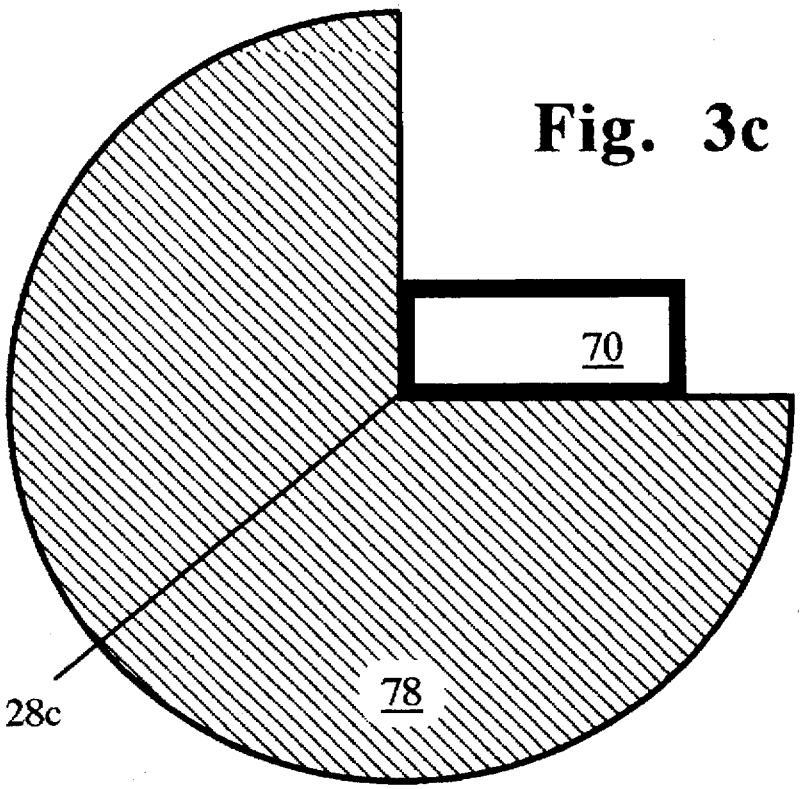
Fig. 3c
Fig. 3d
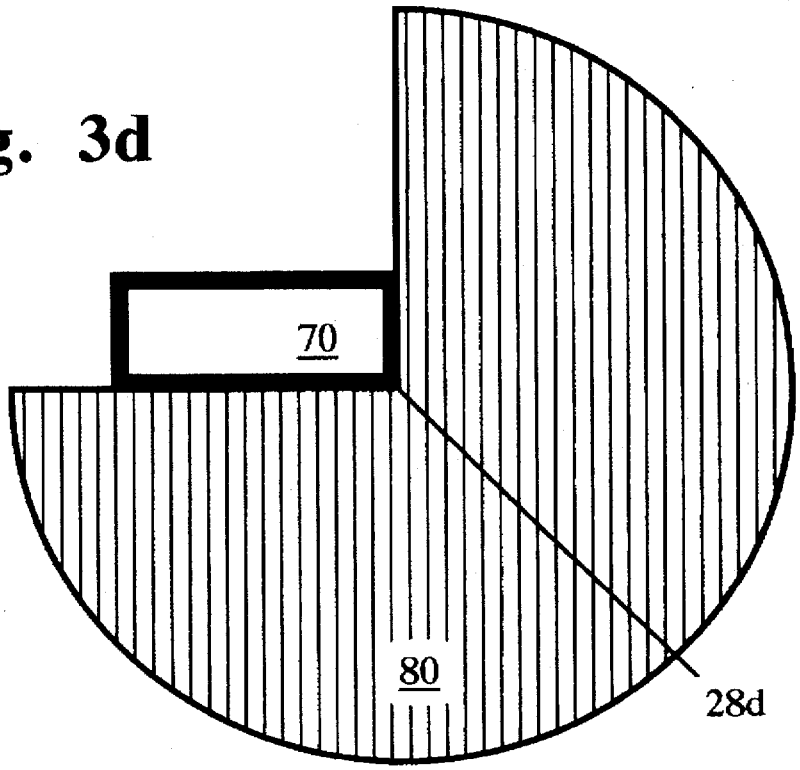

SYSTEM FOR TRACKING AN ARTICLE OR PERSON

FIELD OF THE INVENTION

The present invention relates to systems for tracking articles or persons. More specifically, the present invention relates to those systems which monitor whether the article or person remains within a predefined area. Further, the invention relates to those systems which do not use wire defined boundaries.

BACKGROUND OF THE INVENTION

For the past several years, a number of systems have been developed to provide means for tracking articles or persons within a certain predefined area. U.S. Pat. No. 4,598,272 to Cox discloses a system which uses the strength of an electromagnetic signal to determine the distance between two transceivers, one held by the parent and one held by the child. As the strength of the signal decreases below a predefined level, an alarm is sent to the parent's transceiver to indicate that the child is moving beyond the range of the system. Similar systems are disclosed in U.S. Pat. No. 4,675,656 to Narcisse, U.S. Pat. No. 4,785,291 to Hawthorne, U.S. Pat. No. 4,899,135 to Ghahariiran, U.S. Pat. No. 4,967,695 to Giaunta, U.S. Pat. No. 5,119,072 to Hemingway, U.S. Pat. No. 5,196,825 to Young and U.S. Pat. No. 5,289,163 to Perez, et al.

Theses systems range from the fairly simple to the extremely complex but they all are prone to the problems associated with radio signal strength to determine distance. Often, nulls are generated in the area wherein the article or person is to be restricted. Such nulls are created by reflections of the radio signal off of walls, fences, trees, other pets and even other people walking in the area. Also, if it is desired to track a person, the person's own body will attenuate the radio signal. This could lead to the generation of an alarm signal at an inappropriate location or time. Further, the strength of radio signals varies inversely with the square of the distance. This means that it is very difficult to accurately set the range of the system to the relatively short distances (less than about 100 feet for which these systems are used.

Therefore, there is a need for a system for tracking articles or persons which is relatively simple to use by the consumer. In addition, there is a need for a system for tracking articles or persons which has a fairly stable area of coverage which is not readily disturbed by environmental factors such as the presence of animals or people in the area. Further, there is a need for a system for tracking articles or persons which may be used at conveniently short distances with relatively good control of the range of the system.

It is an object of the present invention to provide a system for tracking articles or persons which uses a wireless means to track an article or person within a particular area.

It is a further object of the present invention to provide such a system which operates effectively over a reasonably long period of time without frequent replacement or recharging of batteries.

It is another object of the present invention to provide such a system which has a fairly stable area of coverage.

It is yet another object of the present invention to provide such a system such that the area of coverage is not readily disturbed by environmental factors such as the presence of animals or people in the area.

It is an additional object of the present invention to provide such a system such that the system may be used at conveniently short distances with relatively good control of the range of the system.

SUMMARY OF THE INVENTION

Having regard to the above and other objects and advantages, the present invention generally provides for a system for tracking articles or persons comprising a base unit for transmitting a series of ultrasonic signals and an alarm signal, a remote unit, removably attached to the article or person, for receiving the series of ultrasonic signals from the base unit and for transmitting an electromagnetic signal upon receipt of the ultrasonic signal from the base unit, and a monitoring unit for receiving the alarm signal.

The base unit further includes means for generating the ultrasonic signals, means for transmitting the ultrasonic signals, means for receiving the electromagnetic signal from the remote unit, means for determining the amount of time from the transmission of the ultrasonic signals to the receipt of the electromagnetic signal from the remote unit, and means for transmitting an alarm signal to the remote unit and the monitoring unit when the amount of time from the transmission of the ultrasonic signals to the receipt of the electromagnetic signal from the remote unit is greater than a predetermined amount of time. The receiver further includes at least one receiving microphone for receiving the series of ultrasonic signals from the base unit, means for transmitting an electromagnetic signal to the base unit upon receipt of the ultrasonic signal from the base unit, means for receiving the alarm signal from the base unit, and means for producing an alarm indication upon receipt of the control signal from the base unit. The monitoring unit further includes at least one receiving antenna for receiving the alarm signal from the base unit, and means for producing an alarm indication upon receipt of the alarm signal.

In a preferred embodiment of the invention, the base unit further includes means for modulating the ultrasonic signals, wherein the signals are modulated to produce non-random patterns of ultrasonic energy. In a further preferred embodiment of the present invention, the ultrasonic signals transmitted by the base unit are frequency, amplitude or pulse modulated.

The present invention also provides a method for tracking an article or person within a predefined area comprising the steps of attaching a releasable ultrasonic energy receiver to the article or person, transmitting a series of ultrasonic signals from a base unit (further including the steps of generating the ultrasonic signals, and transmitting the series of ultrasonic signals), receiving the series of ultrasonic signals with the releasable receiver, transmitting an electromagnetic signal from the releasable receiver to the base unit upon receipt of the ultrasonic signals at the releasable receiver, receiving the electromagnetic signal from the releasable receiver at the base unit, determining the difference in time of the transmission of the ultrasonic signals from the base unit and the receipt of the electromagnetic signal from the releasable receiver at the base unit, transmitting an alarm signal from the base unit to a monitoring unit when the difference in time is greater than a predetermined value, and producing an alarm indication in the monitoring unit in response to the receipt of the alarm signal from the releasable receiver.

In a preferred embodiment of the invention, the step of transmitting a series of ultrasonic signals further includes modulating the ultrasonic signals, wherein the signals are modulated to produce non-random patterns of ultrasonic energy. Such modulating preferably includes amplitude and/ or frequency modulating the transmitted ultrasonic signals. A further preferred embodiment of the invention additionally comprises modulating the transmitted ultrasonic signals in a pulse train having a particular nonrandom pattern.

The present invention also provides a method for producing an area for the tracking of an article or person wherein the area has a predetermined boundary. The method comprises the steps of transmitting ultrasonic signals from a plurality of speakers, receiving the ultrasonic signals at a remote unit releasably attached to the article or person, determining the amount of time from the transmission of the ultrasonic signals, from each of the plurality of speakers, to the reception of the ultrasonic signals at the remote unit, determining the location of the remote unit, based upon the amount of time from the transmission of the ultrasonic signals, from each of the plurality of speakers, to the reception of the ultrasonic signals at the remote unit, with respect to the location of the predetermined boundary, and producing an alarm indication in a monitoring unit when the remote unit reaches the boundary.

In a preferred embodiment of the invention, the predetermined boundary is predetermined by generating a set of points in a logic unit, each point in the set corresponding to a combination of a first difference in time from the transmission of a first set of ultrasonic signals, from a first speaker, and the reception of the first set of ultrasonic signals at the remote unit, and a second difference in time from the transmission of a second set of ultrasonic signals, from a second speaker, and the reception of the second set of ultrasonic signals at the remote unit. The first difference in time represents a first distance from the first speaker to the remote unit and the second difference in time represents a second distance from the second speaker to the remote unit. The combination of the first distance and the second distance represents a unique point on the predetermined boundary.

In another preferred embodiment of the invention, the step of determining the location of the remote unit with respect to the location of the predetermined boundary further comprises the steps of generating a position point in the logic unit corresponding to a combination of a first difference in time from the transmission of a first set of ultrasonic signals, from a first speaker, and the reception of the first set of ultrasonic signals at the remote unit, and a second difference in time from the transmission of a second set of ultrasonic signals, from a second speaker, and the reception of the second set of ultrasonic signals at the remote unit (wherein the first difference in time represents a first distance from the first speaker to the remote unit and the second difference in time represents a second distance from the second speaker to the remote unit, and wherein the combination of the first distance and the second distance represents the position of the remote unit), comparing the position point to the set of points in the logic unit, and determining whether the position point is within the set of points in the logic unit or outside the set of points in the logic unit.

In yet another preferred embodiment of the invention, the step of producing an alarm indication to the monitoring unit when the remote unit reaches the boundary further comprises producing an alarm indication when the position point is outside the set of points in the logic unit.

BRIEF DESCRIPTION OF THE DRAWINGS

In order to provide a further explanation of the present invention the following drawings are provided in which:

FIG. 3*a*–3*d* comprise a schematic illustration of another environment utilizing a plurality of speakers of the system for tracking an article or person of the present invention illustrating the use of equal range settings for all of the speakers wherein FIG. 3*a* shows the area of coverage of a speaker at the comer of a house, FIG. 3*b* shows the area of coverage of a second speaker at a second comer of the house, FIG. 3*c* shows the area of coverage of a third speaker at a third comer of the house and FIG. 3*d* shows the area of coverage of a fourth speaker at a fourth comer of the house;

DETAILED DESCRIPTION OF THE INVENTION

Figure 1:
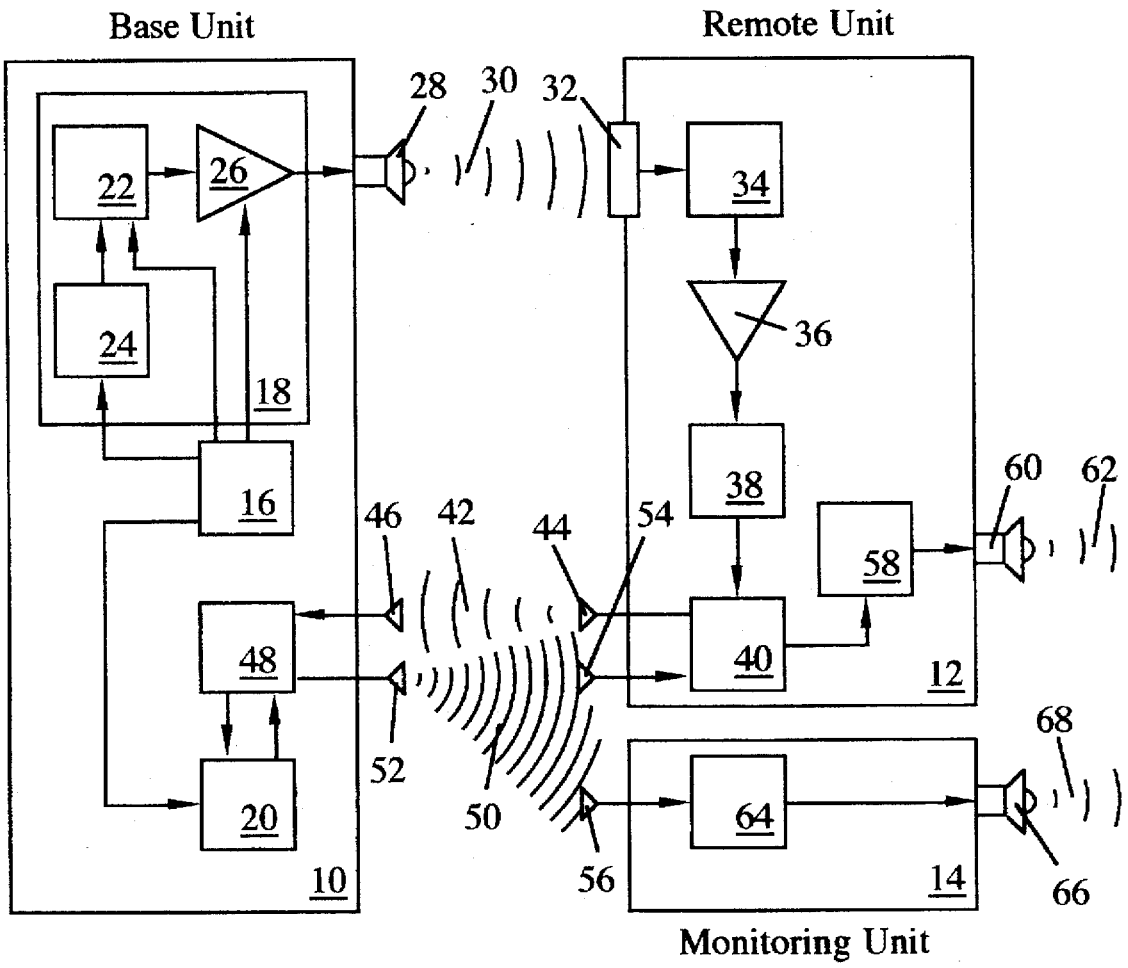
FIG. 1 is a block diagram representation of a system for tracking an article or person according to the present invention.

Referring now to the drawings, FIG. 1 is a block diagram of a system for tracking articles or persons according to the present invention. The system comprises a base unit 10, a receiver or remote unit 12 and a monitoring unit 14. The base unit 10 includes a controller circuit 16 which controls the signals from a ultrasonic signal generator 18. In addition, the controller circuit 16 sends timing signals to a logic unit 20.

In the ultrasonic signal generator 18, a carder frequency source voltage controlled oscillator 22 provides the carrier ultrasonic frequency. An ultrasonic signal modulator 24 applies modulation to the signal from the voltage controlled oscillator 22 which is then sent to an ultrasonic power amplifier 26. The controller circuit 16 provides control inputs to the voltage controlled oscillator 22, the ultrasonic signal modulator 24 and the ultrasonic power amplifier 26. Upon a signal from the controller circuit 16, the power amplifier 26 sends a signal to the speaker 28 which emits an ultrasonic signal 30.

The speaker 28 may be any one of a number of acoustic transducers available, but it is preferred that the speaker 28 uses a piezo element used for high frequency (≧5 kHz) speakers. The ultrasonic signal 30 preferably has a frequency in the range of from about 20 KHz to about 50 kHz. Ideally, the ultrasonic signal is somewhat above the highest frequency that can be detected by the people. Therefore, a more preferred ultrasonic signal 30 frequency is in the range of from about 30 kHz to about 50 kHz.

The ultrasonic signal 30 is received, at the remote unit 12, by an ultrasonic detector 32 which, in practice is an electret microphone or the like well known to practitioners in the art. The ultrasonic detector 32 sends the received ultrasonic signal to a wide band filter 34 to remove acoustic signals which are not within the preferred frequency range of the present invention. That is, the wide band filter 34 filters out acoustic signals which are outside the range of from about 20 kHz to about 90 kHz.

The output of the wide band filter 34 is then sent to a linear amplifier 36 and a demodulator 38. The demodulated signal from the demodulator 38 is then sent to a transceiver 40. The entire ultrasonic receiver, comprising the ultrasonic detector 32, the wide band filter 34, the linear amplifier 36 and the demodulator 38, may be found on a single circuit such as the MC3373 remote control wide band amplifier with detector produced by MOTOROLA.

The transceiver 40 then sends an electromagnetic signal 42 from a transmitting antenna 44 back to the base unit 10 indicating the receipt of the ultrasonic signals 30 by the remote unit 12. The electromagnetic signal is received by the base unit 10 with the receiving antenna 46. The electromagnetic signal is then sent to a transceiver 48. The transceiver 48 then sends a receipt signal to the logic unit 20. The logic unit 20 determines the amount of time from the transmission of the ultrasonic signals from the base unit 10 to the receipt of the electromagnetic signal from the remote unit 12.

The speed of electromagnetic propagation is equal to that of light at $3\times10^8$ meters/second. Therefore, the transmission delay for an electromagnetic signal is $3.33\times10^{-9}$ seconds/meter or about $3.33\times10^{-7}$ seconds for a pet containment area with a radius of 100 meters. Ultrasonic signal propagation is equal to that of the speed of sound at 331.6 meters/second. Therefore, the transmission delay for an ultrasonic signal is $3.01\times10^{-3}$ seconds/meter or about $3.01\times10^{-1}$ seconds for the same pet containment area with a radius of 100 meters. Thus, the electromagnetic signal propagates about a million times faster than the ultrasonic signal. Compared with the ultrasonic transmission delay, the electromagnetic transmissions are substantially instantaneous. Therefore, the electromagnetic signal is used to indicate the initiation of the ultrasonic transmission at the receiver, allowing the receiver to measure the time delay for the ultrasonic signal reception.

During the operation of the present invention, if $\Delta t$ is less than a predetermined value, $t_1$, then the logic unit 20 continues to monitor the value of $\Delta t$. If At is greater than $t_1$ then the logic circuit 20 sends a signal to the transceiver 48 which sends an alarm signal 50 to the remote unit 12 and the monitoring unit 14. The alarm signal 50 is sent from the base unit via the transmitting antenna 52 to the receiving antenna 54 of the remote unit 12 and the receiving antenna 56 of the monitoring unit 14. The alarm signal 50 is received by the transceiver 40 which sends an alarm signal to the alarm generating circuit 58. The alarm generating unit 58 then sends a signal to a speaker 60 which produces an alarm indication 62 at the remote unit 12.

The alarm signal 50 is also received by the receiving antenna 56 of the monitoring unit 14. A transceiver 64 receives the alarm signal from the antenna 56 and generates a signal to a speaker 66 associated with the monitoring unit 14. The speaker 66 then produces an alarm indication 68.

During normal operation of the system according to the present invention, the ultrasonic signal 30 may be modulated in order to allow the remote unit 12 to separate the signal 30 from random environmental signals. Thus, the modulating unit 24 is incorporated into the ultrasonic signal generator 18 and the demodulating unit 36 is likewise incorporated into the remote unit 12.

In the practice of the present invention, the controller 16 of the base unit 10 organizes the ultrasonic signal 30 and encodes the permission range on the signal to the speaker 28. Rather than using a single speaker 28, a plurality of speakers may be used in the base unit 10 to extend the range of the system.

Figure 2:
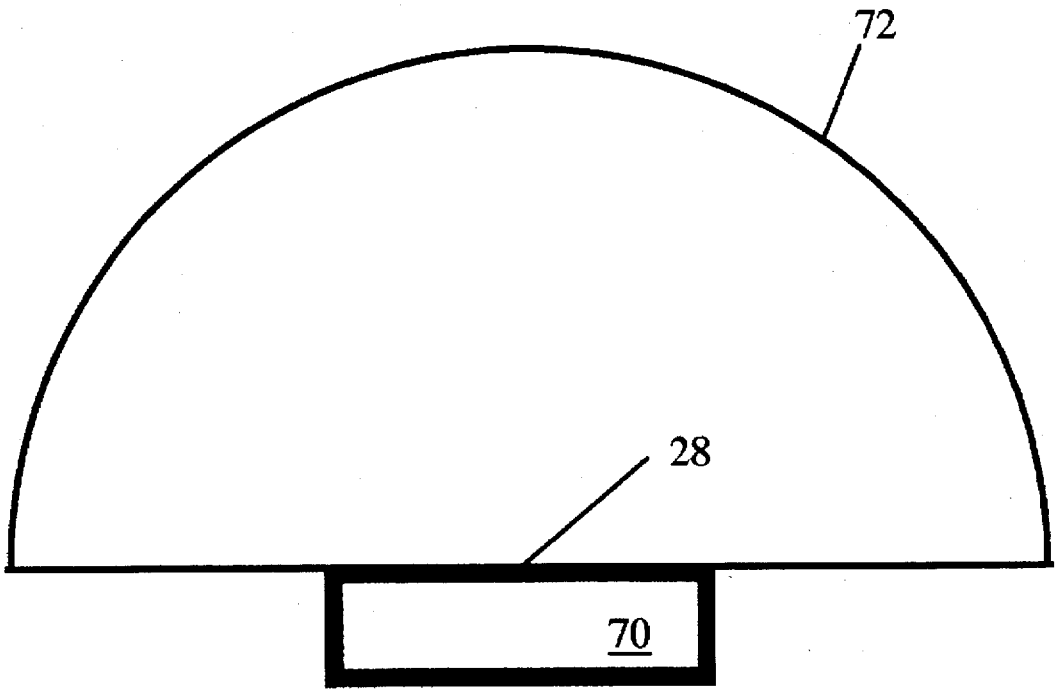
FIG. 2 is a schematic illustration of an environment utilizing a single speaker of the system for tracking an article or person of the present invention illustrating the alarm zone produced.

There is shown in FIG. 2 a schematic illustration of an environment utilizing a single speaker of the system for tracking articles or persons of the present invention illustrating the warning and control zones produced. A single speaker 28 is placed next to a house 70. The speaker 28 sends out an ultrasonic signal in a substantially spherical pattern. At ground level, the pattern of the ultrasonic signal is substantially circular. In the situation shown in FIG. 2, the mass of the house 70 blocks much of the ultrasonic signal such that the propagation pattern is that of a semicircle.

The time it takes for the ultrasonic signal to travel out to the warning distance is $t_1$. So long as the logic circuit 20 determines that $\Delta t$ is less than $t_1$, then the article or person is within the area 72. Once the article or person goes beyond the area 72, then a warning signal is generated by the base unit 10 and an alarm indication is generated by the monitoring unit 14 and/or the remote unit 12.

Figure 3A:
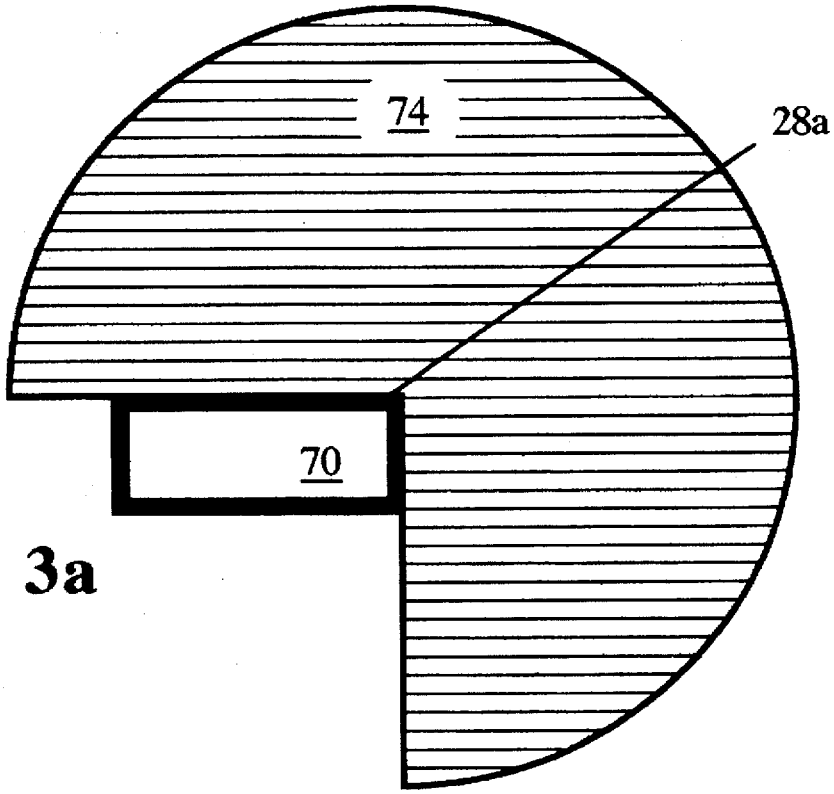
Figure 3B:
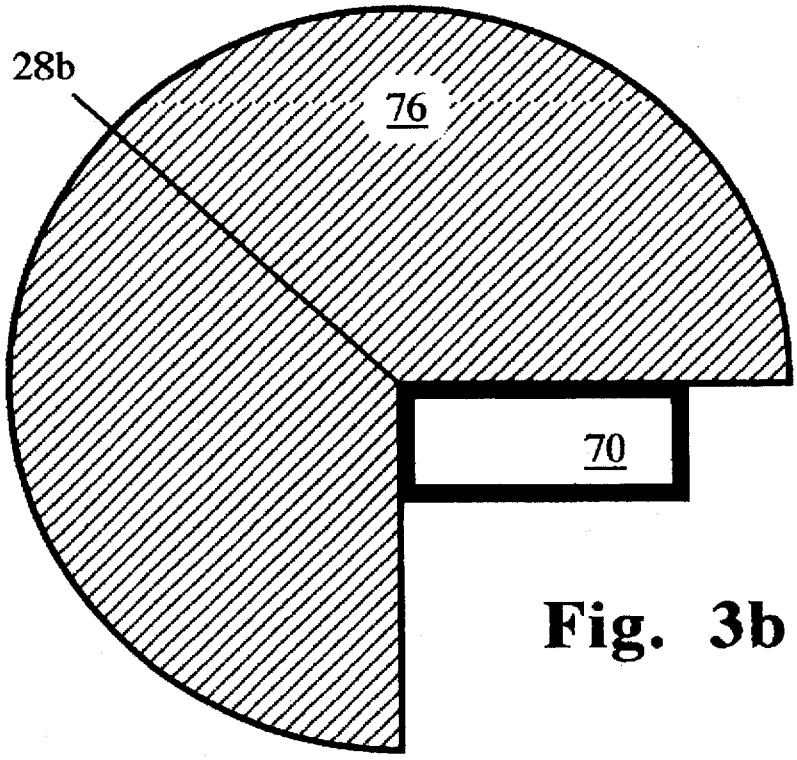

A similar situation is seen when a plurality of speakers is used. FIG. 3 shows a schematic illustration of another environment utilizing a plurality of speakers of the system for tracking articles or persons of the present invention illustrating the use of equal range settings for all of the speakers. Four speakers 28*a*, 28*b*, 28*c* and 28*d* are arranged at the corner of a house 70. Since the speakers are at the comers rather than along one side of the house, the propagation of the ultrasonic signals are in the pattern of a three-quarters circle.

Figure 4:
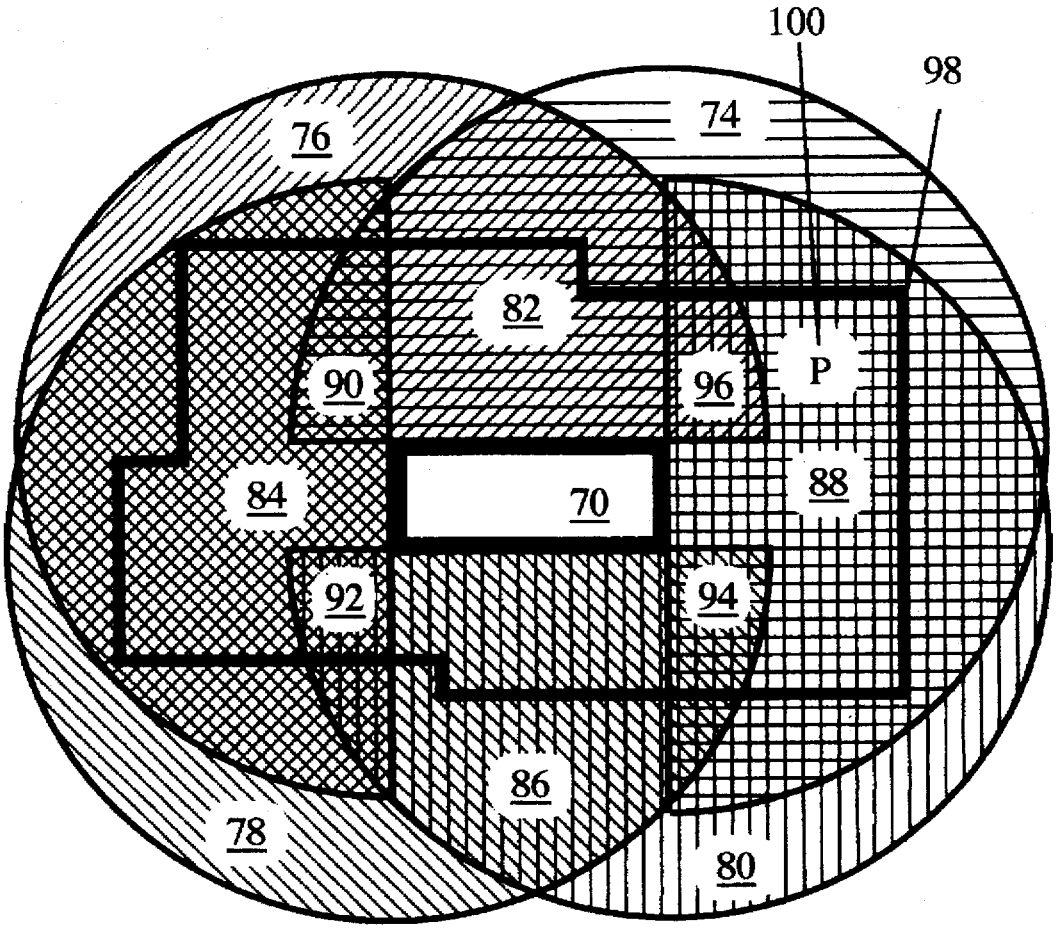
FIG. 4 is a schematic illustration of an environment utilizing a plurality of speakers of the system for tracking an article or person of the present invention illustrating the use of mapping to define an area for the containment of the pet.

The combined coverage of the four speakers 28*a*–28*d* is shown in FIG. 4. The areas of coverage 74, 76, 78 and 80 overlap to give at least double coverage around the house 70. The overlap of the areas 74 and 76 is the area 82; the overlap of the areas 76 and 78 is the area 84; the overlap of the areas 78 and 80 is the area 86; and the overlap of the areas 80 and 74 is the area 88. In addition, there are area where three of the coverage areas overlap. The overlap of areas 74, 76 and 78 is the area 90; the overlap of areas 76, 78 and 80 is the area 92; the overlap of areas 78, 80 and 74 is the area 94; and the overlap of areas 80, 74 and 76 is the area 96.

In the areas of overlap, it is possible to use the time difference between the receipt of the ultrasonic signals from different speakers to define particular points in the areas of coverage. This is possible since the time of receipt of the ultrasonic signal from a particular speaker defines the arc of a circle with a radius, r, in meters, equal to the time, t, in seconds, that it took the ultrasonic signal to travel from the base unit to the remote unit multiplied by the speed of sound, v=331.6 meters/second.

Thus, the distance of a remote unit from a particular speaker n is given by Equation (1).

$$r_n=vt_n, \tag{1}$$

where $r_n$ is the distance of the remote unit from the speaker n, in meters, $t_n$ is the time that it took the ultrasonic signal to travel from the speaker n to the remote unit and v is 331.6 meters/second. When the remote unit is in an area of overlap, such as, for example, the area 82, it will receive signals from both the speaker 28*a* and the speaker 28*b*. The distance of the remote unit from speaker 28*a* would be $$r_{28a}=Vt_{28a} \tag{2}$$

and the distance of the remote unit from speaker 28*b* would be $$r_{28b}=vt_{28}. \tag{3}$$

The two distances, $r_{28a}$ and $r_{28b}$, represent a unique point in the area 82 where those arcs with the radii $r_{28a}$ and $r_{28b}$ cross.

Therefore, it is possible to generate a series of unique points in the areas of double coverage which represent a border within which the article or person of interest is monitored. Such a border 98 is shown in FIG. 4. In practice, the base unit 10 is set to a "mapping" mode to generate the border 98. The remote unit 12 is then carded around the perimeter of the border, for example, the border 98 of FIG. 4. During the time that the remote unit 12 is carded around the perimeter 98, the base unit 10 tracks the remote unit 12 and generates a map of the perimeter 98. At the end of the mapping, the base unit 10 is set to the "normal" mode and the remote unit 12 is attached to the article or person of interest. As the article or person approaches the border 98, it will receive appropriate warning indication. In addition, the monitoring unit 14 will also produce a warning indication.

The map of the border 98 is stored in the logic unit 20 of the base unit 10. As the transceiver 48 receives the signals 42 from the remote unit 12, the logic unit 20 determines the position, p, of the article or person based on the values of the time of receipt of the ultrasonic signals 30 by the remote unit 12. If p is within the border 98, then the remote unit and the monitoring unit receive no warning signal and no warning indication is produced. If p is too close to the border 98, then the logic unit 20 generates a warning signal through the transceiver 48 and a warning indication is produced at the monitoring unit 14 and/or the remote unit 12.

Figure 5:
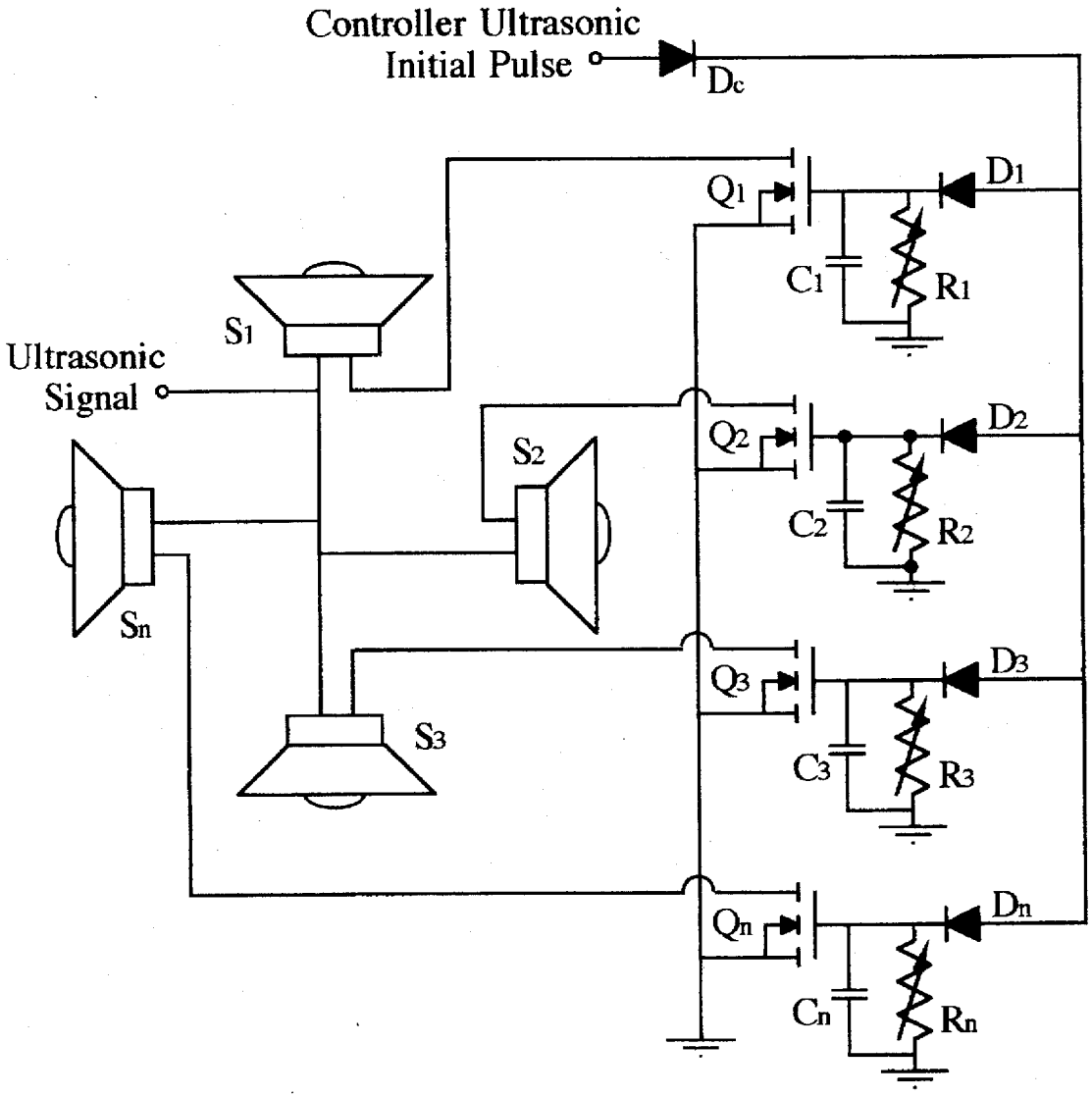
FIG. 5 is a block diagram representation of a pulse width modulation control circuit for use with a wireless system for tracking an article or person according to the present invention.

A preferred method of coding the speakers such that the individual ultrasonic signals from each of the individual speakers may be distinguished is to use pulse width modulation (PWD) which varies the duration of the ultrasonic signal applied to each speaker. FIG. 5 shows a block diagram representation of a pulse width modulation control circuit for use with a system for tracking articles or persons according to the present invention.

A high ultrasonic initial pulse from the controller in the base unit charges the capacitors $C_1$ through $C_n$ turning on transistors $Q_1$ through $Q_n$. The transistors $Q_1$ through $Q_n$ are isolated by the diodes $D_1$ through $D_n$. The high ultrasonic initial pulse from the controller is also isolated by the diode $D_c$ and returns to a low. The transistors $Q_1$ through $Q_n$ then begin to discharge through the resistors $R_1$ through $R_n$. The discharge rate is determined by the resistance value of the resistors $R_1$ through $R_n$ and the capacitance values of the capacitors $C_1$ through $C_n$. Thus, the ultrasonic signal applied to the speakers $S_1$ through $S_n$ is transmitted only during the discharge of the transistors $Q_1$ through $Q_n$. By appropriate adjustment of the resistors $R_1$ through $R_n$, the speakers $S_1$ through $S_n$ will transmit pulse width modulated ultrasonic signals.

It is necessary to determine which ultrasonic signal received by the remote unit 12 belongs to which speaker when using a multiple speaker system. Using the environment shown in FIG. 4, a remote unit 12 is at a location 100 which is within the limits of the areas 74 and 80 (in the overlap area 88). Without the ability to distinguish which signal is coming from which speaker, it would be very difficult to determine the position, p, of the remote unit 12. The use of pulse width modulation allows the remote unit 12 to distinguish the various speakers.

Thus, it can be seen from the foregoing, that the present invention provides a system for tracking articles or persons which restrains the article or person to a particular area without the necessity of wires being buried or being left exposed. In addition, the present system requires little power on the part of the receiver and thus can utilize standard batteries for power.

Having thus described various preferred embodiments of the invention and several of its benefits and advantages, it will be understood by those of ordinary skill that the foregoing description is merely for the purpose of illustration and that numerous substitutions, rearrangements and modifications may be made in the invention without departing from the scope and spirit of the appended claims.

What is claimed is:

1. A system for tracking an article or person, the system comprising:

(a) a base unit for transmitting a series of ultrasonic signals and an alarm signal;

(b) a remote unit, removably attached to the article or person, for receiving the series of ultrasonic signals from the base unit and for transmitting an electromagnetic signal upon receipt of the ultrasonic signal from the base unit; and (c) a monitoring unit for receiving the alarm signal, wherein said base unit further includes:

(a1) means for generating the ultrasonic signals, (a2) means for transmitting the ultrasonic signals, (a3) means for receiving the electromagnetic signal from the remote unit, (a4) means for determining the amount of time from the transmission of the ultrasonic signals to the receipt of the electromagnetic signal from the remote unit, and (a5) means for transmitting an alarm signal to the remote unit and the monitoring unit when the amount of time from the transmission of the ultrasonic signals to the receipt of the electromagnetic signal from the remote unit is greater than a predetermined amount of time, wherein said receiver further includes:

(b1) at least one receiving microphone for receiving the series of ultrasonic signals from the base unit, (b2) means for transmitting an electromagnetic signal to the base unit upon receipt of the ultrasonic signal from the base unit, (b3) means for receiving the alarm signal from the base unit, and (b4) means for producing an alarm indication upon receipt of the control signal from the base unit, and wherein the monitoring unit further includes:

(c1) at least one receiving antenna for receiving the alarm signal from the base unit, and (c2) means for producing an alarm indication upon receipt of the alarm signal.

2. The system of claim 1 wherein said base unit further includes means for modulating the ultrasonic signals, wherein the signals are modulated to produce non-random patterns of ultrasonic energy.

3. The system of claim 2 wherein the ultrasonic signals transmitted by said base unit are amplitude modulated.

4. The system of claim 2 wherein the ultrasonic signals transmitted by said base unit are frequency modulated.

5. The system of claim 2 wherein the ultrasonic signals transmitted by said base unit are modulated in a pulse train having a particular nonrandom pattern.

6. A method for tracking an article or person, the method comprising:

(a) attaching a releasable ultrasonic energy receiver to the article or person;

(b) transmitting a series of ultrasonic signals from a base unit, further including:

(1) generating the ultrasonic signals, (2) transmitting the series of ultrasonic signals;

(c) receiving the series of ultrasonic signals with the releasable receiver;

(d) transmitting an electromagnetic signal from the releasable receiver to the base unit upon receipt of the ultrasonic signals at the releasable receiver;

(e) receiving the electromagnetic signal from the releasable receiver at the base unit;

(f) determining the difference in time of the transmission of the ultrasonic signals from the base unit and the receipt of the electromagnetic signal from the releasable receiver at the base unit;

(g) transmitting an alarm signal from the base unit to a monitoring unit when the difference in time is greater than a predetermined value; and (h) producing an alarm indication in the monitoring unit in response to the receipt of the alarm signal from the releasable receiver.

7. The method of claim 6 wherein said transmitting a series of ultrasonic signals further includes modulating the ultrasonic signals, wherein the signals are modulated to produce non-random patterns of ultrasonic energy.

8. The method of claim 7 further comprising amplitude modulating the transmitted ultrasonic signals.

9. The method of claim 7 further comprising frequency modulating the transmitted ultrasonic signals.

10. The method of claim 7 further comprising modulating the transmitted ultrasonic signals in a pulse train having a particular nonrandom pattern.

11. A method for producing an area for the tracking of an article or person wherein the area has a predetermined boundary, the method comprising (a) transmitting ultrasonic signals from a plurality of speakers;

(b) receiving the ultrasonic signals at a remote unit releasably attached to the article or person;

(c) determining the amount of time from the transmission of the ultrasonic signals, from each of the plurality of speakers, to the reception of the ultrasonic signals at the remote unit;

(d) determining the location of the remote unit, based upon the amount of time from the transmission of the ultrasonic signals, from each of the plurality of speakers, to the reception of the ultrasonic signals at the remote unit, with respect to the location of the predetermined boundary; and (e) producing an alarm indication in a monitoring unit when the remote unit reaches the boundary.

12. The method of claim 11 wherein the predetermined boundary is predetermined by generating a set of points in a logic unit, each point in the set corresponding to a combination of:

(1) a first difference in time from the transmission of a first set of ultrasonic signals, from a first speaker, and the reception of the first set of ultrasonic signals at the remote unit, and (2) a second difference in time from the transmission of a second set of ultrasonic signals, from a second speaker, and the reception of the second set of ultrasonic signals at the remote unit, wherein the first difference in time represents a first distance from the first speaker to the remote unit and the second difference in time represents a second distance from the second speaker to the remote unit, and wherein the combination of the first distance and the second distance represents a unique point on the predetermined boundary.

13. The method of claim 12 wherein the step of determining the location of the remote unit with respect to the location of the predetermined boundary further comprises the steps of:

(1) generating a position point in the logic unit corresponding to a combination of a first difference in time from the transmission of a first set of ultrasonic signals, from a first speaker, and the reception of the first set of ultrasonic signals at the remote unit, and a second difference in time from the transmission of a second set of ultrasonic signals, from a second speaker, and the reception of the second set of ultrasonic signals at the remote unit, wherein the first difference in time represents a first distance from the first speaker to the remote unit and the second difference in time represents a second distance from the second speaker to the remote unit, and wherein the combination of the first distance and the second distance represents the position of the remote unit;

(2) comparing the position point to the set of points in the logic unit; and (3) determining whether the position point is within the set of points in the logic unit or outside the set of points in the logic unit.

14. The method of claim 13 wherein the step of producing an alarm indication to the article or person when the remote unit reaches the boundary further comprises producing an alarm indication when the position point is outside the set of points in the logic unit.

15. A method for producing an area for the tracking of an article or person wherein the area has a predetermined boundary, the method comprising:

(a) transmitting ultrasonic signals from a plurality of speakers;

(b) generating a set of points in a logic unit, each point in the set corresponding to a combination of:

(1) a first difference in time from the transmission of a first set of ultrasonic signals, from a first speaker, and the reception of the first set of ultrasonic signals at the remote unit, and (2) a second difference in time from the transmission of a second set of ultrasonic signals, from a second speaker, and the reception of the second set of ultrasonic signals at the remote unit, wherein the first difference in time represents a first distance from the first speaker to the remote unit and the second difference in time represents a second distance from the second speaker to the remote unit, and wherein the combination of the first distance and the second distance represents a unique point on the predetermined boundary;

(c) receiving the ultrasonic signals at a remote unit releasably attached to the article or person;

(d) determining the amount of time from the transmission of the ultrasonic signals, from each of the plurality of speakers, to the reception of the ultrasonic signals at the remote unit;

(e) determining the location of the remote unit, based upon the amount of time from the transmission of the ultrasonic signals, from each of the plurality of speakers, to the reception of the ultrasonic signals at the remote unit, with respect to the location of the predetermined boundary further including the steps of:

(1) generating a position point in the logic unit corresponding to a combination of a first difference in time from the transmission of a first set of ultrasonic signals, from a first speaker, and the reception of the first set of ultrasonic signals at the remote unit, and a second difference in time from the transmission of a second set of ultrasonic signals, from a second speaker, and the reception of the second set of ultrasonic signals at the remote unit, wherein the first difference in time represents a first distance from the first speaker to the remote unit and the second difference in time represents a second distance from the second speaker to the remote unit, and wherein the combination of the first distance and the second distance represents the position of the remote unit;

(2) comparing the position point to the set of points in the logic unit; and (3) determining whether the position point is within the set of points in the logic unit or outside the set of points in the logic unit; and (f) producing an alarm indication in a monitoring unit when the position point is outside the set of points in the logic unit.

* * * * *